US006749696B2

(12) United States Patent
Freier et al.

(10) Patent No.: US 6,749,696 B2
(45) Date of Patent: Jun. 15, 2004

(54) PROCESS FOR PRODUCING A COLD-ROLLED STRIP OR SHEET OF STEEL AND STRIP OR SHEET WHICH CAN BE PRODUCED BY THE PROCESS

(75) Inventors: Klaus Freier, Wolfenbuttel (DE); Volker Flaxa, Salzgitter (DE); Birgit Reichert, Braunschweig (DE)

(73) Assignee: Salzgitter AG, Peine (DE)

( * ) Notice: Subject to any disclaimer, the term of this patent is extended or adjusted under 35 U.S.C. 154(b) by 124 days.

(21) Appl. No.: 10/052,487

(22) Filed: Jan. 23, 2002

(65) Prior Publication Data

US 2003/0145919 A1 Aug. 7, 2003

(30) Foreign Application Priority Data

Jan. 23, 2001 (DE) ..... 101 02 932

(51) Int. Cl.[7] ..... C22C 38/04; C22C 38/14; C21D 8/02

(52) U.S. Cl. ..... 148/320; 148/333; 148/603; 148/651

(58) Field of Search ..... 148/320, 651, 148/603, 333, 652, 661

(56) References Cited

U.S. PATENT DOCUMENTS

| | | | | |
|---|---|---|---|---|
| 4,584,035 A | * | 4/1986 | Arai et al. | 148/320 |
| 5,139,580 A | | 8/1992 | Freier et al. | |
| 5,795,410 A | | 8/1998 | Liu | |
| 5,906,690 A | | 5/1999 | Engl et al. | |
| 6,143,100 A | | 11/2000 | Sun | |
| 6,162,308 A | | 12/2000 | Heckelmann et al. | |

FOREIGN PATENT DOCUMENTS

| | | | | |
|---|---|---|---|---|
| DE | 38 03 064 | | 1/1988 | |
| DE | 285 298 | | 1/1989 | |
| DE | 195 47 181 | | 12/1995 | |
| DE | 196 22 164 | | 6/1996 | |
| EP | 0 400 031 B1 | | 1/1989 | |
| EP | 0 780 480 | | 9/1996 | |
| JP | 403044423 A | * | 2/1991 | C21D/9/462 |
| JP | 404268057 A | * | 9/1992 | C23C/2/06 |
| JP | 07216501 A | * | 8/1995 | C21D/8/02 |
| RU | 2165465 | * | 4/2001 | C21D/8/04 |
| WO | WO 89/07158 | | 8/1989 | |

OTHER PUBLICATIONS

XP 002038993 Article titled: Recent Development in Bake–hardenable Sheet Steel for Automotive Body Panels N. Mizui et al., 2. XP–002199112 abstract dated 1982.

German Article dated Sep. 1975 Titled: Kaltgewaltzes Feinblech und Band mit gewahrleisteter Mindesttstreckgrenze zum Kaltumformen.

* cited by examiner

*Primary Examiner*—Deborah Yee
(74) *Attorney, Agent, or Firm*—Whitham, Curtis & Christofferson, PC

(57) ABSTRACT

The production of a cold-rolled strip or sheet of steel with good deforming properties, which is subjected to recrystallizing annealing and, if appropriate, a dressing operation after hot rolling, coiling and cold rolling and has a bake-hardening potential after a subsequent deformation and for a subsequent temperature treatment, succeeds because the recrystallizing annealing is carried out in a bell-type furnace while coiled and because the strip or sheet is subjected to cooling at a cooling rate of ≧1° C./s after the recrystallizing annealing from a temperature T of 200° C.≦T≦$A_1$. It is consequently possible to obtain properties of bell-annealed steels and nevertheless attain a bake-hardening effect, in particular for C contents of ≧0.02%.

16 Claims, 11 Drawing Sheets

PROCESS FOR PRODUCING A COLD-ROLLED STRIP OR SHEET OF STEEL AND STRIP OR SHEET WHICH CAN BE PRODUCED BY THE PROCESS

BACKGROUND OF THE INVENTION

The invention relates to a process for producing a cold-rolled strip or sheet of steel with good deforming properties, which is subjected to recrystallizing annealing and, if appropriate, dressing operation after hot rolling, coiling and cold rolling and has a bake-hardening potential after a subsequent deformation and for a subsequent temperature treatment.

The invention also relates to a cold-rolled strip or sheet with good deforming properties which can be produced by the process, With a bake-hardening potential after a subsequent deformation and for a subsequent temperature treatment ($BH_2$ potential).

In automobile construction, for example, there is a need for easily deformable sheets, which must be formed relatively thin in order not to allow the Freight of the vehicle to become too great. Sheets of steel of this type are generally produced in the form of a strip, in that a steel slab is cast, hot-rolled and coiled at a certain intermediate temperature. After cooling or the coiled strip to essentially ambient temperature, the strip is cold-rolled to the final thickness. To eliminate the stresses occurring thereby within the material, a recrystallizing annealing is carried out. Subsequently, the strip is generally gently rolled again with a degree of deformation between approximately 0.5 and 2% (dressing).

The easy deformability of the steels is fundamentally at odds with an increase in the strength values of the steel grade, since the increased strength is accompanied in principle by an impairment of the easy deformability. Higher-strength steel grades (for example ZStE and ZStEi), which in spite of higher strength values can be deformed relatively well, have been developed. Steel grades of this type are known, for example, as ZStE from steel-iron material sheets SEW 093 and 094 and as isotropic steel ZStEi, while the conventional "soft" steel grades are known as St12 to St15 (corresponding to DC01, DC03, DC04, DC05 in accordance with DIN EN 10130). The steel grades differ here with regard to the addition of microalloying elements and with regard to how the process is conducted. A special steel of this type is, for example, the isotropic steel ZStEi, as described in DE 38 03 064 C2, EP 0 400 031 B1 or DD 285 298 B5, the disclosure of which is incorporated as part of this description.

For many steel grades, there is the possibility of combining good deformability with an increased yield strength after production, by producing the steel with what is known as a bake-hardening potential. The bake-hardening affect has the effect that, in a temperature treatment or the steel, as performed for example during the stove-enamelling of vehicle body sheets, a strengthening is brought about, that is an increase in the yield strength This is an artificial aging of the steel, which brings about the additional increase in strength. The increase in strength is consequently achieved after the deformation of the sheet for creating the desired component has been carried out, with the result that the increase in strength does not have any adverse effect on the deformation of the sheet. It has been found that prior deformation of the sheet influences the bake-hardening affect. The bake-hardening effect brought about only by the temperature treatment, without prior deformation, is indicated as the $BH_0$ value, while a measure or the bake-hardening effect after a deformation has been performed is the $BH_2$ value, which indicates the increase in strength after a deformation of the sheet by 2% on account of a subsequent temperature treatment—standardized at 170° C. for 20 minutes.

The bake-hardening effect is based on a content of dissolved carbon in the steel which lies above the state of equilibrium. To produce this supersaturation of the steel with dissolved C atoms, the recrystallization annealing is carried out after the cold rolling with a continuous annealing furnace. The increase in temperature in the continuous annealing furnace causes carbon to go into solution. Since the sheet is only heated up briefly in the continuous annealing furnace, a temperature distinctly above $A_1$ is used for the recrystallization. The rapid cooling of the steel strip has the effect of producing the fraction of dissolved C atoms, which is several orders of magnitude above the state of equilibrium.

If, on the other hand, the annealing of the coiled steel strip is carried out in the bell-type furnace, i.e. for a comparatively long time, and the associated slow cooling is performed in air, the steel strip remains in the state of equilibrium, with the result that no aging potential (bake-hardening potential) occurs if the carbon content is $\geqq 0.02\%$. Only when there are lower carbon contents, which can be set only by complex vacuum treatment, can an aging potential be produced, since it is only with difficulty that the C atoms in solution lead to an iron carbide precipitation (cementite), on account of their low density and the associated longer diffusion paths, and therefore part remains supersaturated in solution, For C contents of $\geqq 0.02\%$, the precipitation of the carbon takes place when there is slow cooling, with the result that no dissolved carbon is available for the aging potential. The temperature treatment causes the carbon atoms in the solution to diffuse into dislocation regions of the matrix. This causes the dislocations to be blocked, with the result that an increased amount of stress is required to produce a plastic flow in the material again. This effect is increased considerably by prior deformation of the steal strip supersaturated with dissolved C The deforming operation, for example by deep drawing, leads to a significant increase in the dislocation density. In the case of the temperature treatment, as performed for example in stove enamelling, the carbon atoms diffuse into the dilated regions of the dislocations. In practice, therefore, the bake-hardening effect is relevant after a prior deformation (characterized by $BH_2$).

Depending on the degree of deformation, the forming carried out on the sheets leads to a cold hardening (work hardening). For the use or the bake-hardening steels, the overall strength, obtained from the cold hardening resulting from the forming and the bake hardening resulting from the temperature treatment, is relevant. The known bake-hardening steels, which are produced with a continuous annealing furnace, have an approximately constant yield-strength profile for the sum of the work hardening and bake hardening over the degree of prestraining as a variable. The bake-hardening effect is therefore scarcely relevant in cases of relatively great strain, on account of the highly predominantly cold-hardening component. It is therefore known that the use of bake-hardening steels is predominantly of interest for components of large surface area which undergo only slight forming operations, such a for example mud guards, engine bonnets, car doors and roofs.

It is also known that the bake-hardening effect increases with the content of dissolved atoms up to a saturation value. An excessive content of dissolved C atoms leads to a lack of aging resistance of the steel sheet during age hardening. For bake-hardening steels, therefore a content of dissolved carbon of between 5 and 10 ppm is regarded am optimal.

The restriction of use of the bake-hardening effect to non-vacuum steels which have undergone recrystallizing annealing in a continuous annealing furnace leads to considerable restrictions on the production of suitable steel sheets. It has therefore not been possible in the past to produce advantageous properties of steel sheets, which preferably require recrystallizing annealing in bell-type annealing furnaces, such as for example the production of steel sheets with planar isotropy or quasi isotropy, with a bake-hardening effect.

SUMMARY

The invention is therefore based on the problem of making possible the production of strips or sheets of steel of the type mentioned at the beginning with a bake-hardening potential which does not have the conventional restrictions.

To achieve this object, a process of the type mentioned at the beginning is characterized according to the invention in that the recrystallizing annealing is carried out in a bell-type furnace while coiled and in that the strip or sheet is subjected to cooling at a cooling rate of $\geqq 1°$ C./s after the recrystallizing annealing from a temperature T of $200° \text{ C.} \leqq T \leqq A_1$.

This process according to the invention consequently allows the production of a bake-hardening steel strip or sheet which has undergone recrystallizing annealing in a bell-type furnace, preferably while firmly coiled, to be precise even if the C content in the steel is $\geqq 0.02\%$.

In a surprising way, it is possible by the brief annealing according to the invention after the cooling of the recrystallizing-annealed strip or sheet to $\leqq 150°$ C., preferably to approximately room temperature, to bring C precipitated as carbides back into solution. Since the temperature of the brief annealing lies below the $A_1$ temperature of the steel, the technological properties of the steel are not otherwise significantly changed, in particular its texture, by this annealing. On account of the brief annealing and the subsequent cooling, which may be performed in the customary way with air but also with water, part of the dissolved C remains in solution and leads to the aging potential for the subsequent temperature treatment, for example during stove-enamelling.

The brief annealing is preferably brought about in a continuous annealing furnace. To produce an adequate bake-hardening effect, at a low annealing temperature T a relatively long annealing period must be maintained, while higher annealing temperatures considerably reduce the annealing period required. It is therefore preferred to use a temperature T of the brief annealing of $\geqq 450°$ C. It is also preferred to set the annealing period of the brief annealing to between 2 minutes and 5 minutes.

It will generally be advisable to dress the strip or sheet after the brief annealing, in other words to deform it gently in the customary way. It may also be advisable if the strip or sheet has already been dressed before the brief annealing, although this does not always appear to be required.

For the production of galvanized sheets or strips, it is particularly expedient to use hot galvanizing of the sheet or strip at least as part of the brief annealing. However, the process according to the invention may also be used for sheets which are not to be galvanized at all or galvanized electrolytically i.e., without the effect of heat.

DESCRIPTION OF THE DRAWING FIGURES

DETAILED DESCRIPTION OF THE PREFERRBD EMBODIMENTS

Figure 1:
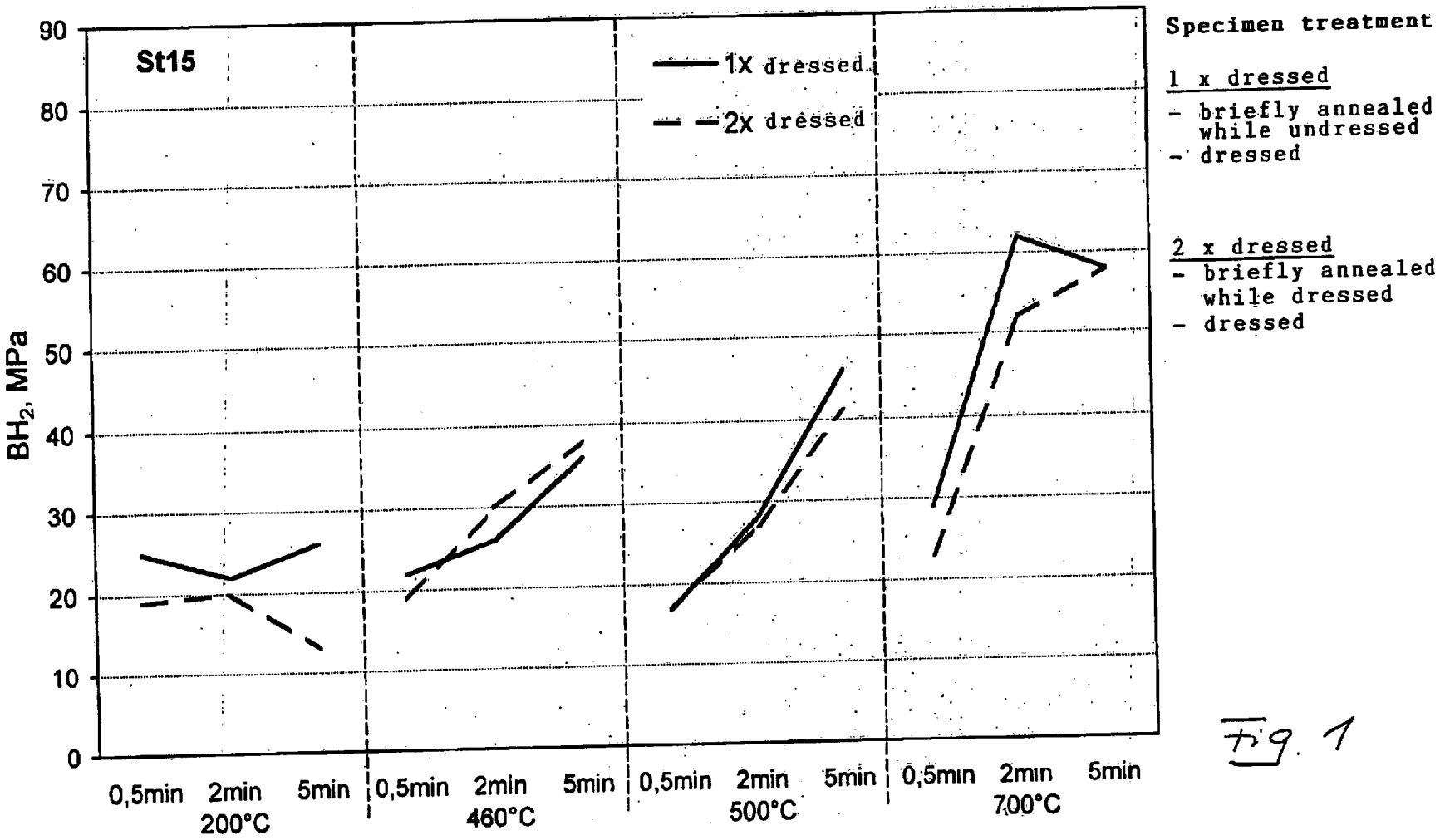
FIG. 1 shows graphs of the measurement results for the $BH_2$ effect for the steel St15.

The strip or sheet produced by the process according to the invention differs from conventional strips or sheets with a bake-hardening potential in that the overall hardening or the steel (work hardening+bake hardening) increases with greater prior deforming of the sheet. Furthermore, the steel according to the invention contains cementite precipitations in the matrix and at the grain boundaries. Customary, continuously-annealed bake-hardening steels are virtually free from cementite. If these steels are subjected to an overaging treatment, cementite does form, but with loss of the bake-hardening effect. By contrast, the steel according to the invention has cementite precipitations and a bake-hardening effect. This also applies if the steel has a C content of $\geqq 0.02\%$. After the stove-enamelling, the sheet has a yield strength significantly increased by the bake-hardening effect, i.e. by at least 15 MPa, preferably by at least 30 MPa.

The steel according to the invention may have any desired analyses known for cold-rolled strips or sheets with good deforming properties. The strip or sheet according to the invention may therefore be produced from a steel of the steel grade St12 to St15, ZStE or ZStEi.

The steel according to the invention is preferably composed as follows:

C 0.02 to 0.12%, preferably 0.03 to 0.08%
Si max 0.50%, preferably max. 0.40%
Mn 0.1 to 1.2%, preferably 0.1 to 1.0%
P max. 0.1%, preferably max. 0.08%
S max. 0.025%, preferably max. 0.02%
N max. 0.009%
Al 0.01 to 0.08;, preferably 0.015 to 0.08%
if appropriate, additionally;
Ti 0005 to 0.06%, preferably 0.01 to 0.04%
and, if appropriate, additionally:
Nb 0.005 to 0.06%, preferably 0.01 to 0.04%
—for isotropic steels—;
if appropriate, additionally:
Ti max. 0.22% and, if appropriate, in addition
Nb max. 0.22%
—for ZStE steels—;
remainder iron and unavoidable impurities.

Unless lower limits have been specified for the components stated above, they result from, unavoidable impurities with these elements.

The steel according to the invention may have a hot-galvanized surface and have been dressed after the hot galvanizing.

The brief annealing according to the invention may be performed at a constant temperature over the annealing time, but also at different annealing temperatures during the annealing period.

The invention is to be explained in more detail below on the basis of some examples.

Corresponding tests have been carried out with steels of the grades St15, St14, two variants of the grade ZStE220i and the grade ZStE340, the chemical compositions of which are given in the enclosed Table 1.

Consequently, steel grades which all have a C content of ≧0.02% were used for the tests. In the case of the steel ZStE340, the C content is even 0.075%.

The "soft" grades st15 and St14 have no relevant amounts of microalloying elements (Ti, V, Nb, Mo). By contrast, the isotropic steel grade ZSt220 is characterized by a titanium content which can lie between 0.01 and 0.04% and in the test examples is set to approximately 0.02%. The higher-strength grade ZSt340 has a similar titanium content and, in addition, a significant niobium content.

The investigation of the steel grades St14 and St15 yielded no relevant differences for the parameters of interest here. The same applies to the tests with the two cold strips of the grade ZStE220i. Therefore, the result of only one representative of these grades is respectively indicated and discussed below.

Since the steel grades used are commonly available on the market and therefore sufficiently known to a person skilled in the art, a person skilled in the art is familiar with the process steps required for producing the steel grades and their special features for achieving the desired steel grades. It is therefore possible to dispense here with a detailed description. For the isotropic steel grades, reference is made to the production processes described in DE 38 03 064 C2, EP 0 400 031 B1 and DD 285 298 B5, the process parameters of which are made the subject-matter or the disclosure of this description.

All the steel grades used were, in the customary way, cast into a slab at the required temperatures and subsequently hot-rolled. After reeling at a suitable intermediate temperature, cooling in air was performed. The cold-rolling Steps were subsequently carried out. After that, the steel strip was recrystallizing-annealed in the bell-type furnace, the customary annealing period lying between 20 and 70 hours.

For some of the tests carried out here, the steel strip cooled to approximately room temperature was used dressed and for some it was used undressed, before performing the brief annealing according to the invention, preferably in a continuous furnace To be able to establish the $BH_2$ effect, which is all that is significant in practice, the material was prestrained.

In all cases, the cooled material was dressed after the brief annealing.

FIG. 1 shows the measurement results for the $BH_2$ effect for the steel St15 in dependence on the annealing temperature and the annealing period, which was respectively set at 0.5 minutes, 2 minutes and 5 minutes. The specimens not dressed before the annealing have been designated "1×dressed", because of the dressing after the annealing, the predressed specimens as "2×dressed".

It is evident that, already at the annealing temperature of 200° C. and with a short annealing period, there is an increased $BH_2$ potential, which rises for all the specimens with increasing annealing temperature and increasing annealing period, with no increase, or no significant increase, in the $BH_2$ potential being achieved any longer at the annealing temperature of 700° C. by prolonging the annealing period beyond 2 minutes.

For all the specimens, the dressing of the material before the brief annealing does not produce any notable increase in the $BH_2$ effect, in some cases there is even a notable decrease.

Figure 2:
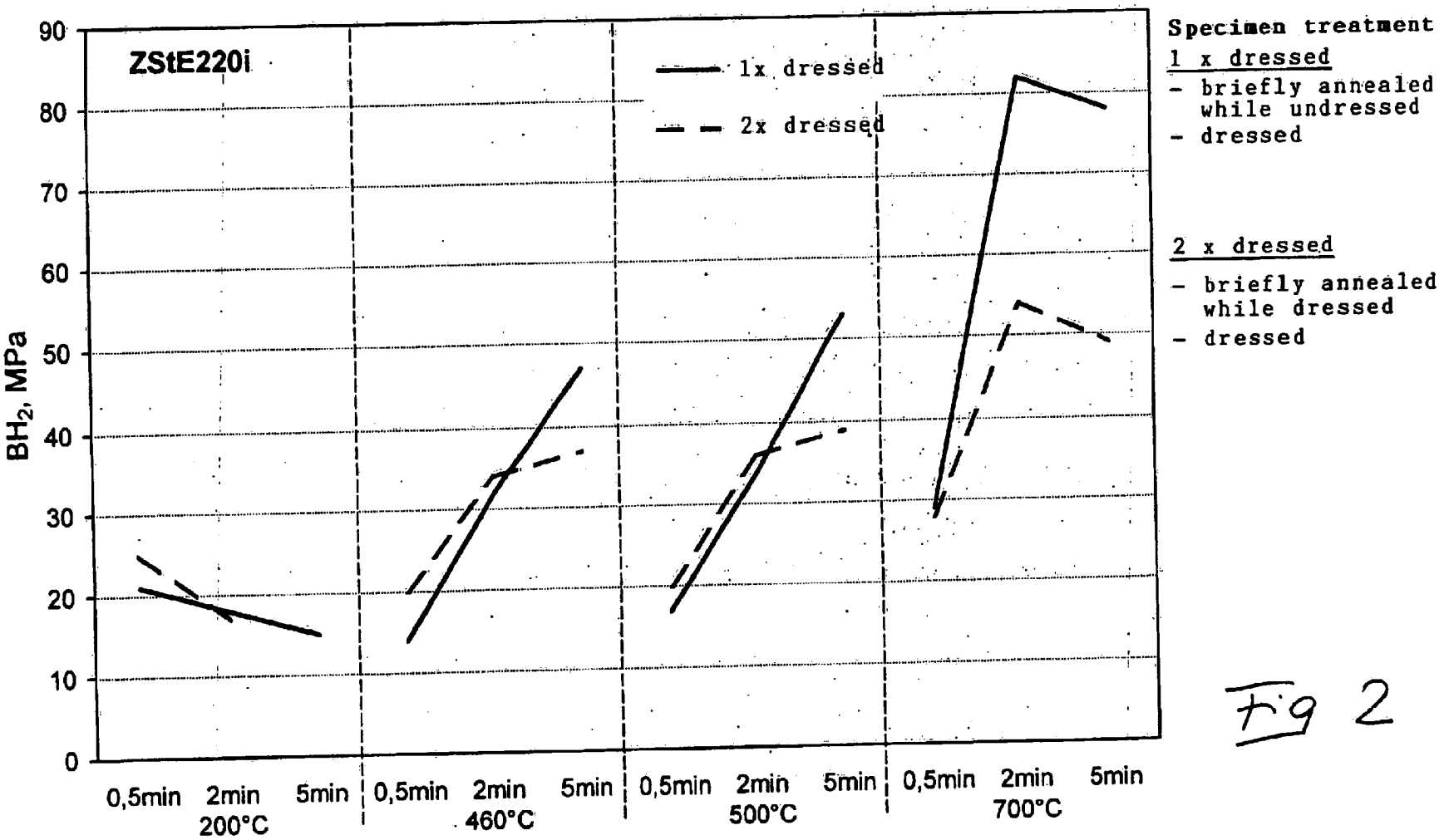
FIG. 2 shows graphs of the measurement results for the $BH_2$ effect for the steel ZStE220i.

FIG. 2 shows the results for the same investigations in the case of the steel ZStE220i. A very great $BH_2$ effect is obtained with an annealing temperature of 700° C. and an annealing period of 2 minutes Prolonging the annealing period at this temperature leads to a reduction in the $BH_2$ effect. Here, too, dressing before the brief annealing tends to be harmful for the magnitude of the $BH_2$ effect.

Figure 3:
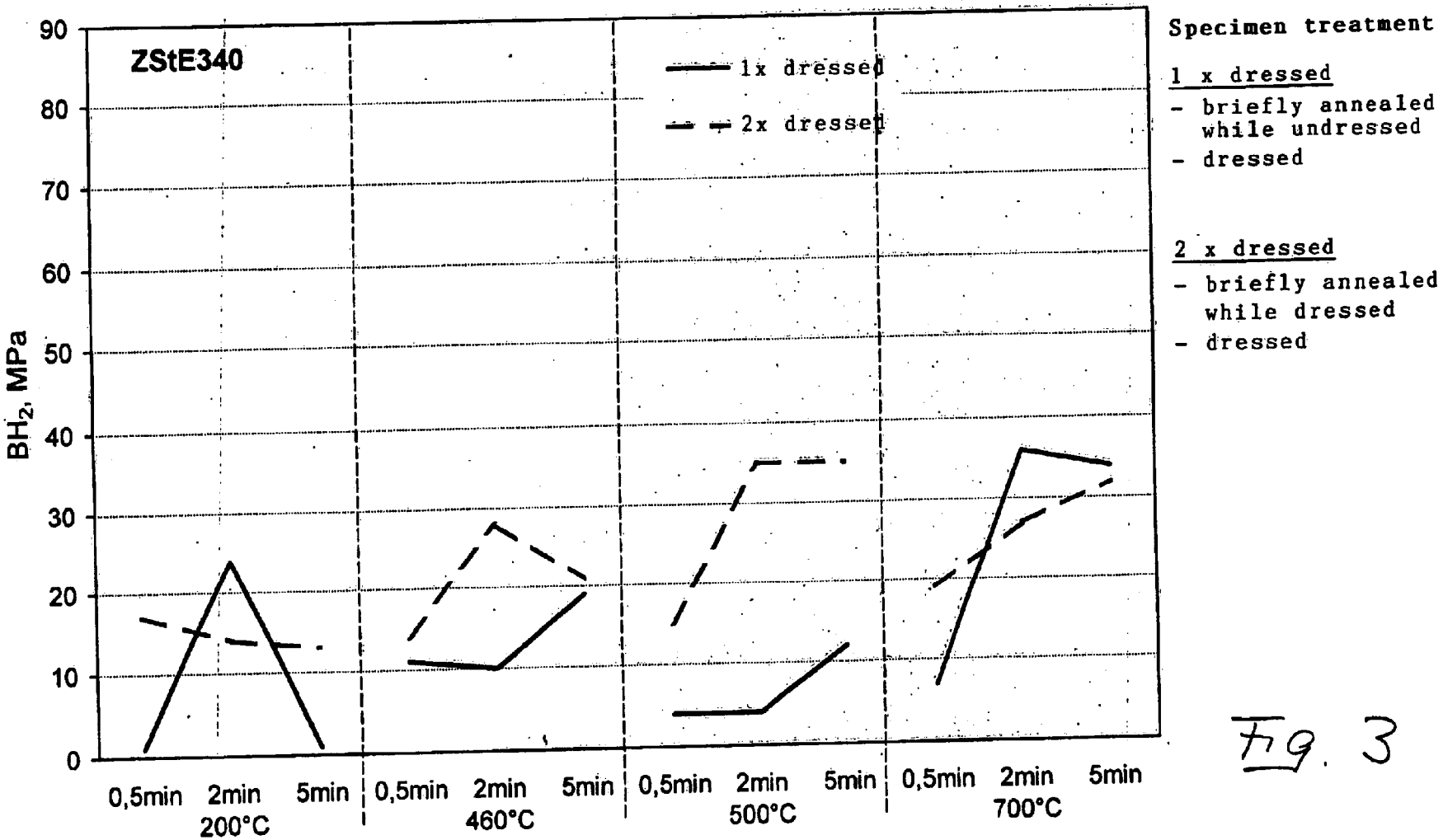
FIG. 3 shows graphs of the measurement results for the $BH_2$ effect for the steel ZStE340.

The results represented in FIG. 3 for the steel grade ZStE340 clearly illustrate that for this case the dressing before the brief annealing is favourable at least for average annealing temperatures with the low annealing temperature of 200° C., a maximum is obtained with the annealing period of 2 minutes for the 1×dressed steel. For shorter and longer annealing periods, the $BH_2$ effect even goes back to 0.

Figure 4:
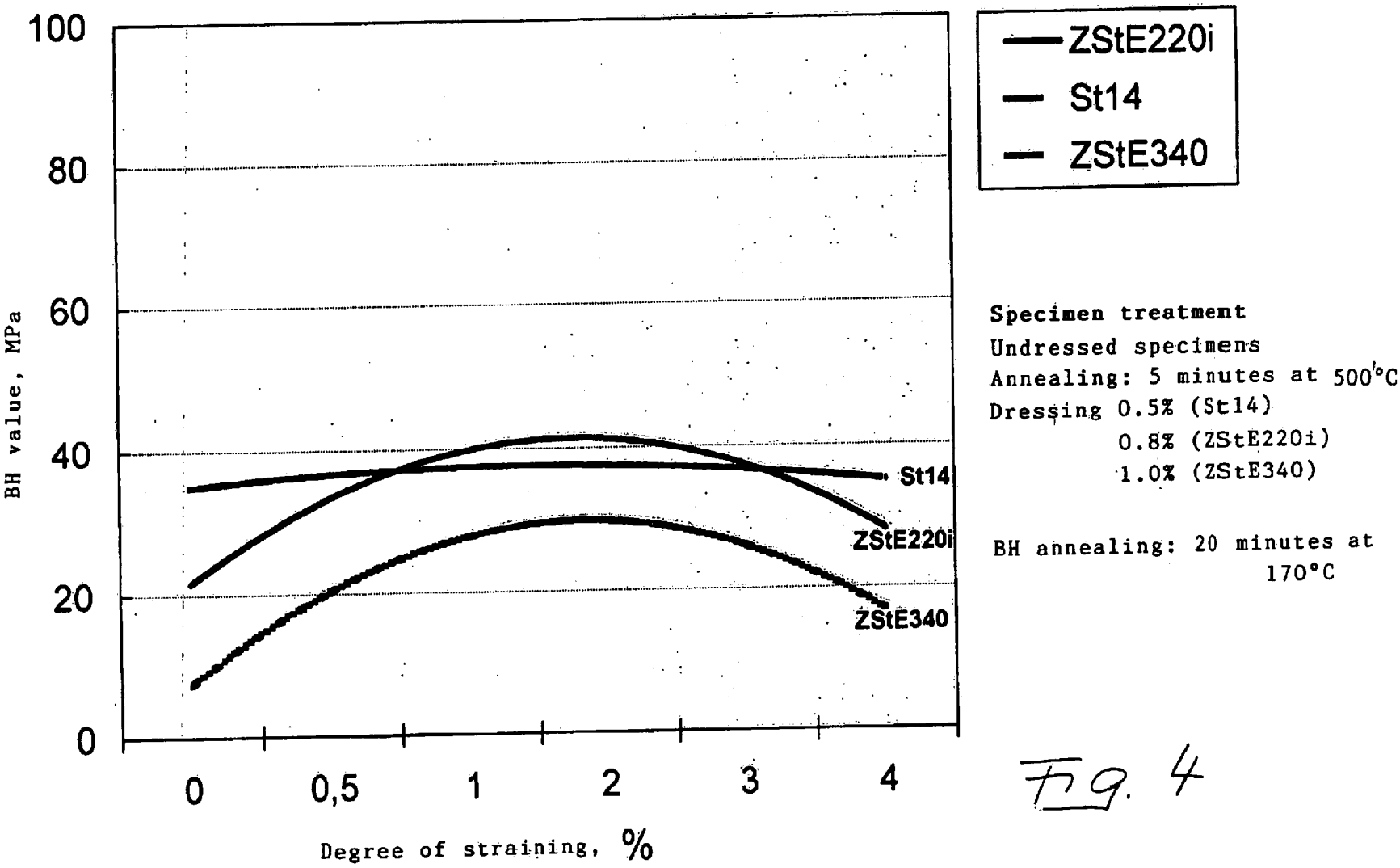
FIG. 4 is a graph of the strain results for different specimens after annealing at 500° C. for 5 minutes.
Figure 5:
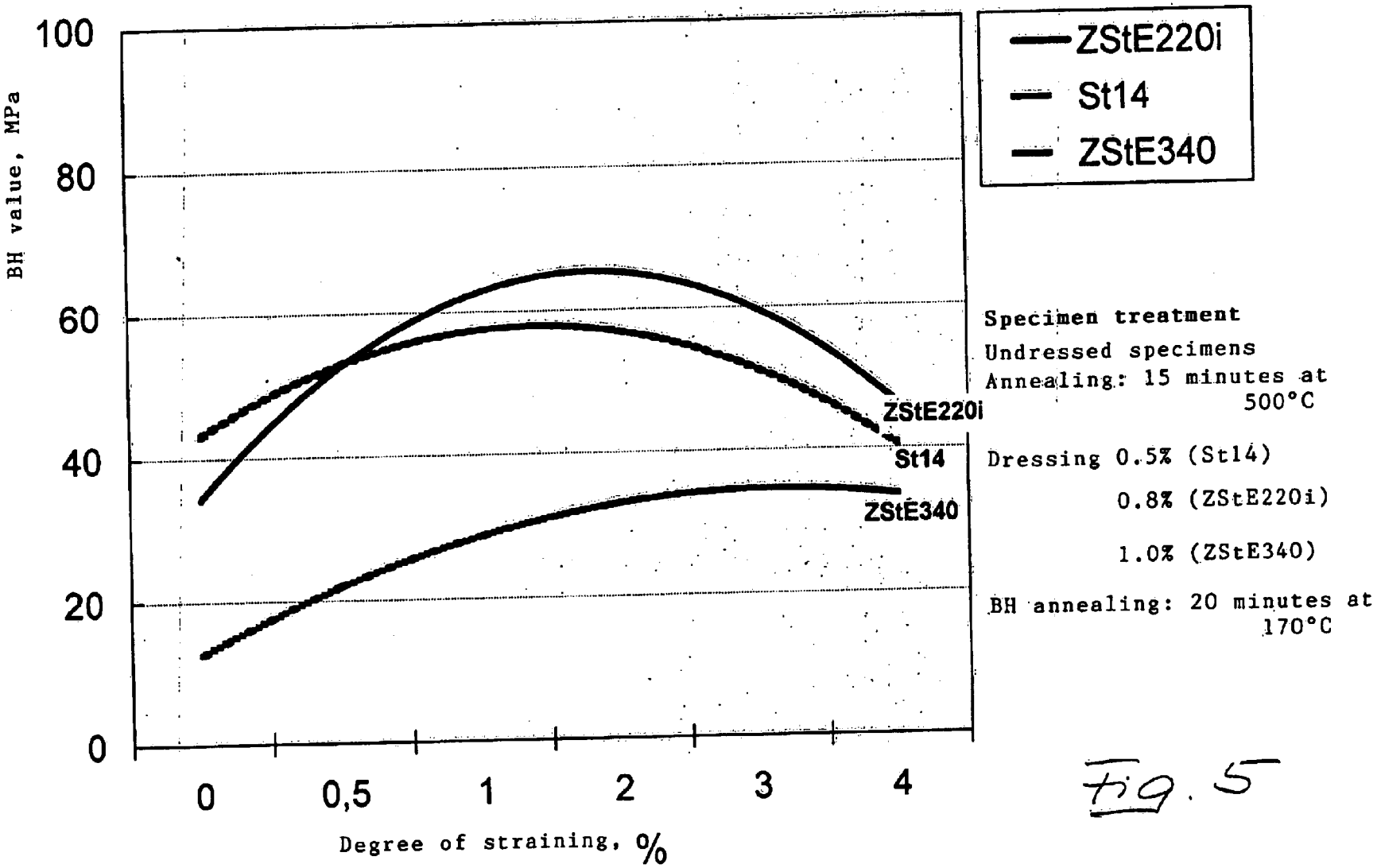
FIG. 5 is a graph of the strain results for different specimens after annealing at 500° C. for 15 minutes.
Figure 6:
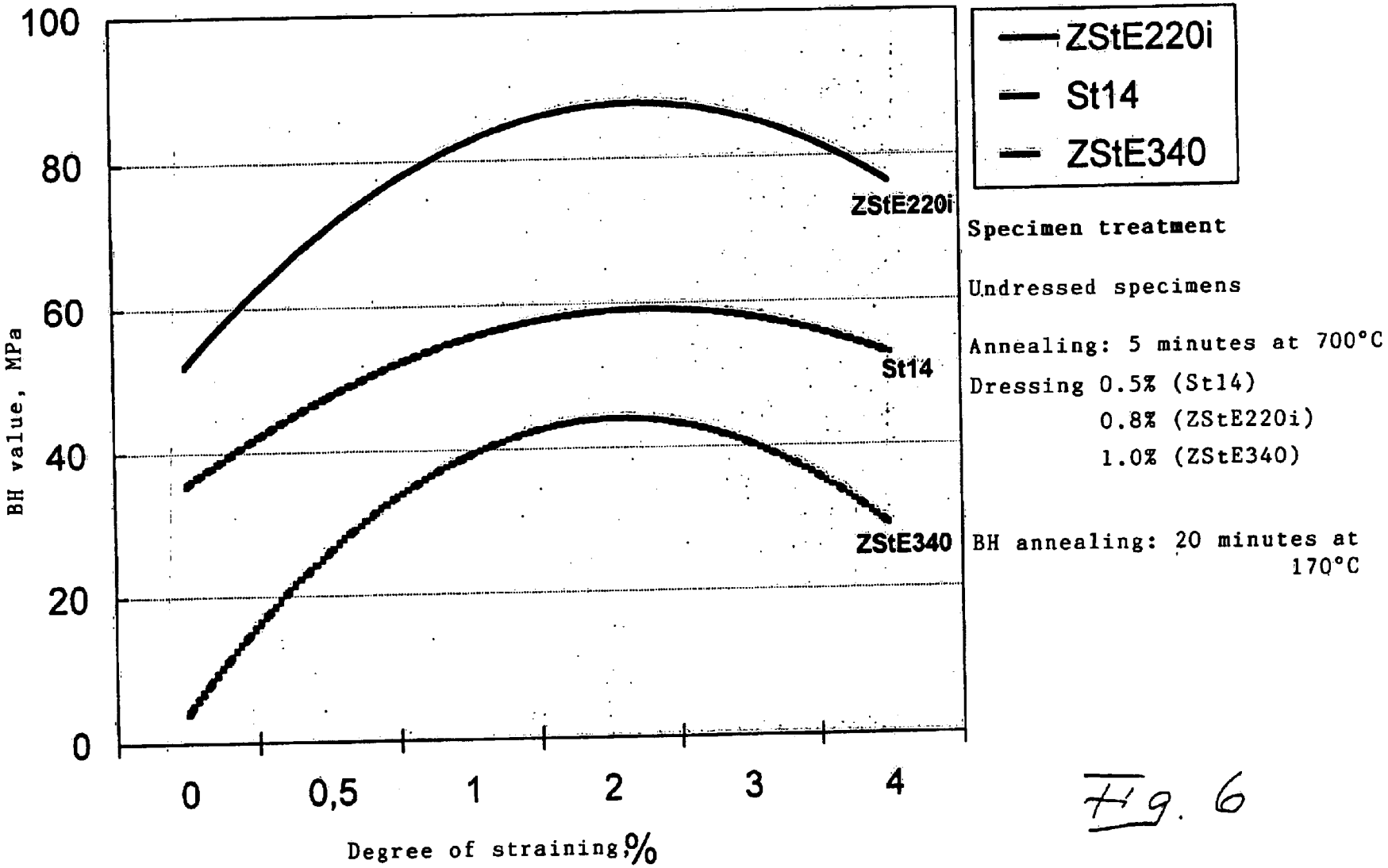
FIG. 6 is a graph of the strain results for different specimens after annealing at 700° C. for 5 minutes.

FIGS. 4 to 6 clearly illustrate the dependence of the BH value on the degree of prior straining of the material. In all cases, a more or less clearly defined maximum is formed with approximately 2% degree of straining, while conventional bake-hardening steels have a BH value which falls as the degree of straining increases.

FIG. 4 shows the results for undressed specimens of the grades ZSt220i, St14 and ZSt340, which have been annealed for 5 minutes at 500° C. and deformed between 0.5 and 1% during dressing, dependent on the steel grade. The bake-hardening annealing took place in accordance with the testing specifications at 170° C. for 20 minutes.

The results represented in FIG. 5 relate to the same steels with the same degrees of dressing, but the brief annealing having been performed at 500° C. for an annealing period of 15 minutes.

The results represented in FIG. 6 relate to the steel grades treated in the same way, which were annealed at 700° C. for 5 minutes. What is striking here is the high bake-hardening potential for the isotropic steel grade ZStE220i, which was prestrained with a degree of deformation of between 2 and 3%.

Figure 7:
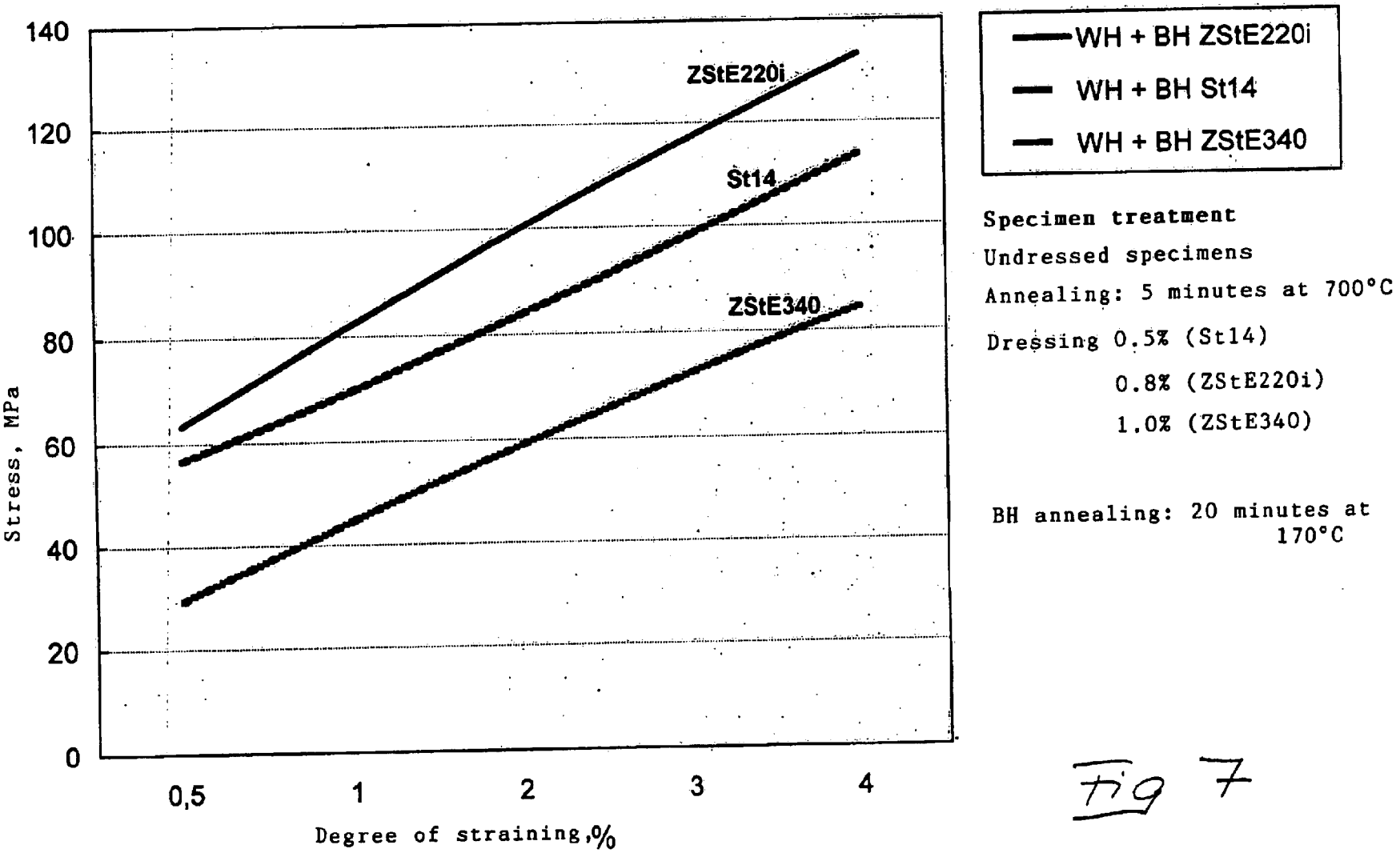
FIG. 7 is a graph of the strain results for different specimens after annealing at 700° C. for 5 minutes.

In FIG. 7, for the throe steel grades, the sum of the work hardening (WH) and the bake hardering (BH) is indicated in dependence on tho degree of straining. While conventional bake-hardening steel grades show an essentially constant sum of the rise in yield strength over the different degrees of straining, the steel grades according to the invention have a rise in yield strength which increases with the degree of straining. The steels treated according to the invention therefore differ perceptibly in their mechanical properties from the conventionally produced bake-hardening steels.

Figure 8:
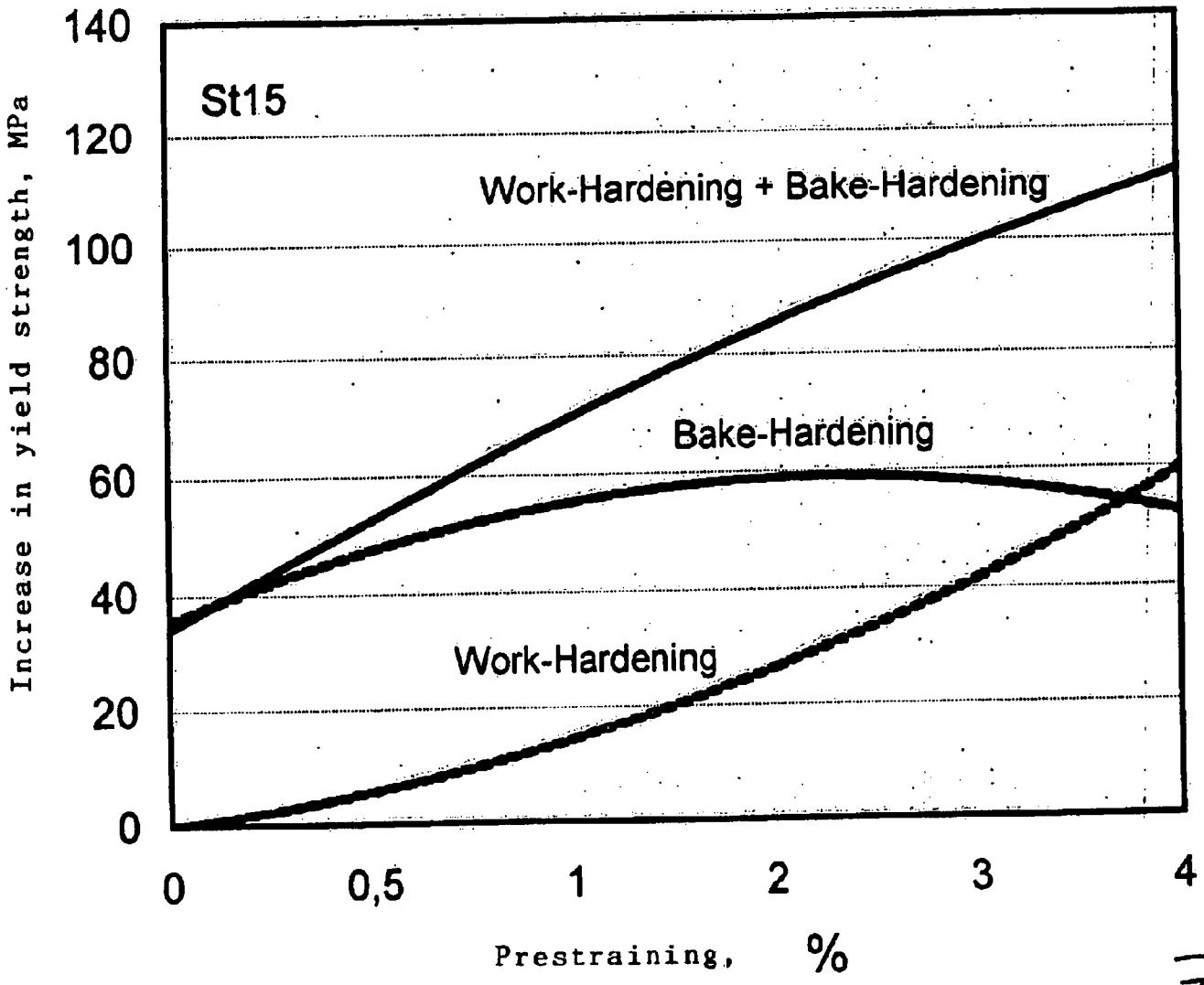
FIG. 8 is a graph showing the effects of prestraining on St15.
Figure 9:
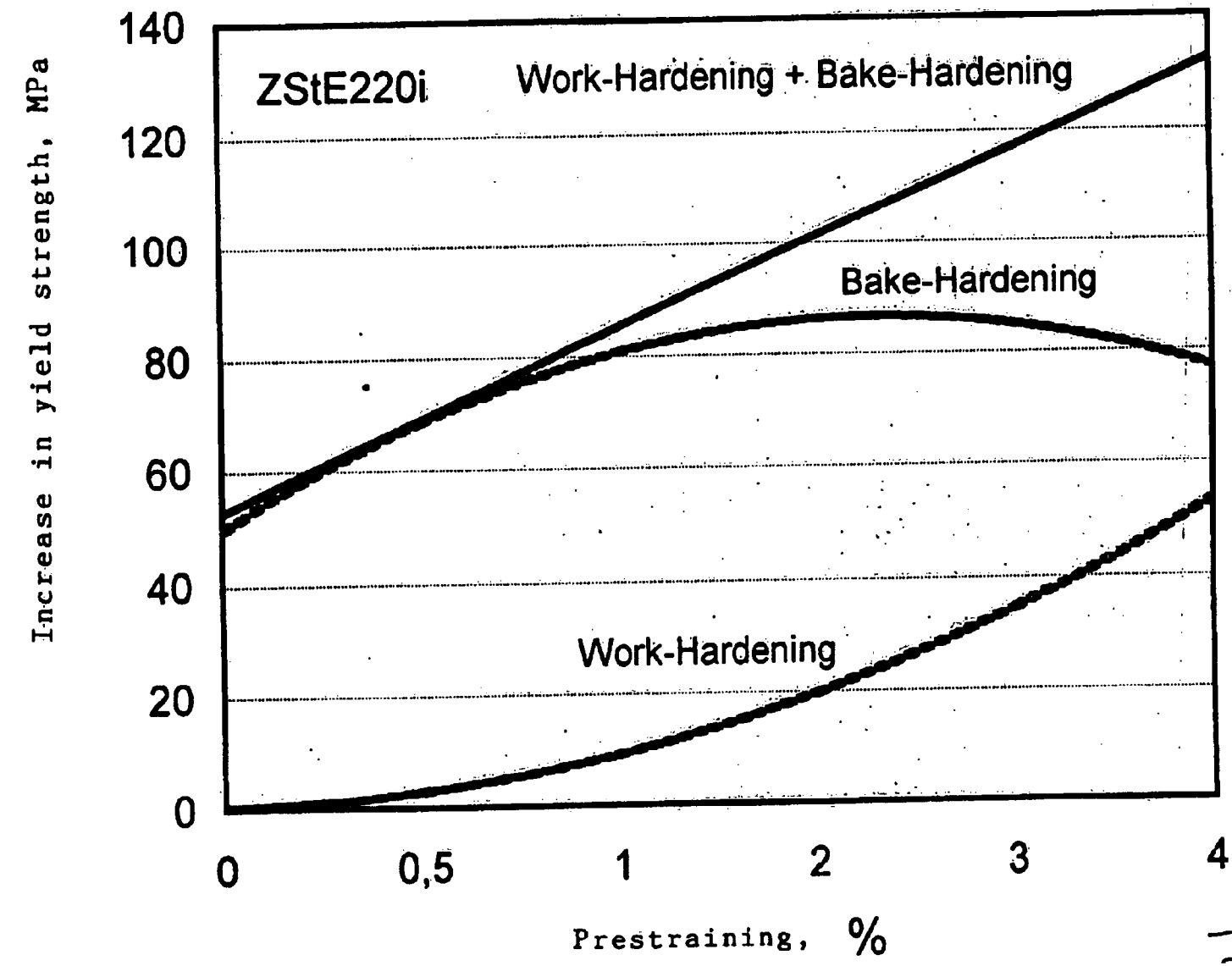
FIG. 9 is a graph showing the effects of prestraining on ZStE220i.
Figure 10:
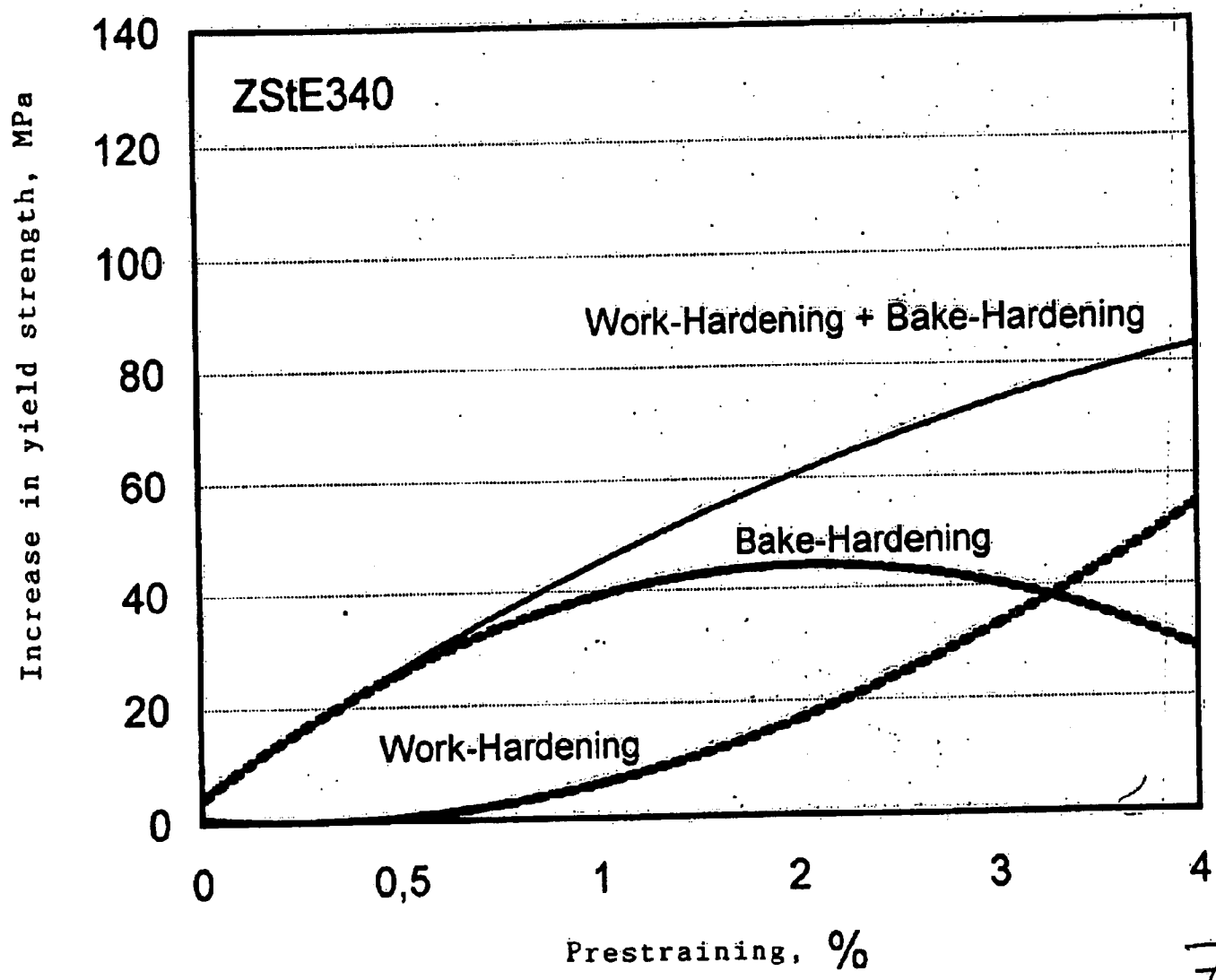
FIG. 10 is a graph showing the effects of prestraining on ZStE340.

FIGS. 8 to 10 clearly illustrate the profile of the work-hardening curve and of the bake-hardening curve in dependence on the degree of prestraining for the steel grades St15 (FIG. 8), ZStE220i (FIG. 9) and ZStE340 (FIG. 10). While the pure bake-hardening effect tends to decrease again with increasing prestraining, the work-hardening effect increases disproportionately, resulting in the rising cumulative curve for the steel according-to the invention.

Figure 11:
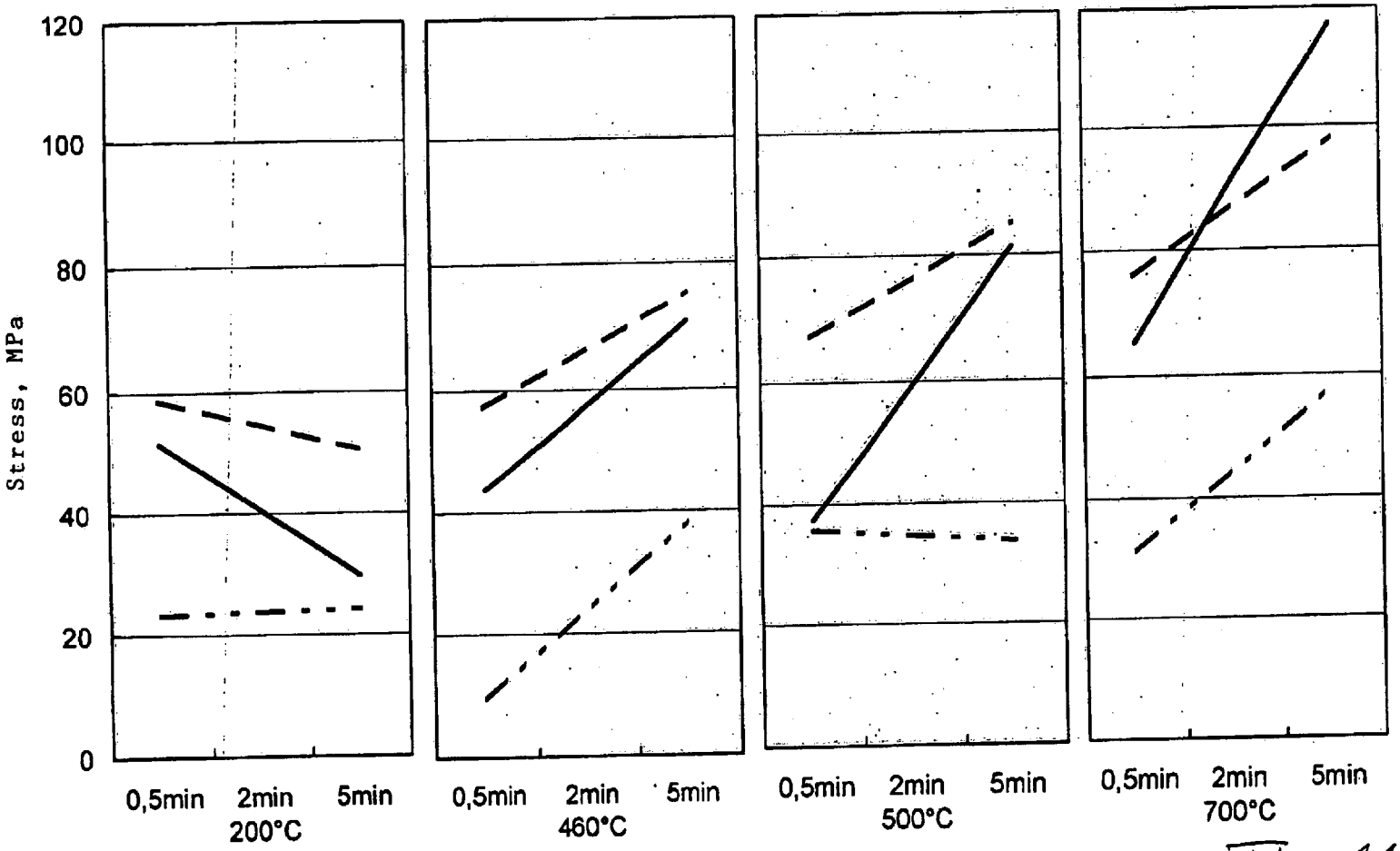
FIG. 11 shows graphs illustrating the effects of additional annealing.

FIG. 11 clearly illustrates the dependence of the sum of the rise in yield strength on the annealing temperatures and the annealing periods. For all the steel grades, the highest rise in yield strength is obtained with the highest (permissible) annealing temperature of approximately 700° C. with a long annealing period (5 minutes). A further increase in the annealing temperature is not possible, since the $A_1$ value (approximately 720° C. must not be exceeded during the annealing operation. Exceeding the $A_3$ temperature would cause transformations which would adversely change the properties of the steel.

The main mechanical values for steels treated according to the invention with a $BH_2$ effect are compared in Table 2 with the mechanical properties of the steel grades as they are presented in the European standard EN 10 130, in a material sheet W5/94 of the Applicant or in the steel iron material sheets SEW 093 and SEW 094.

All percentages given are % by weight.

TABLE 1

| Grade | C | Si | Mn | P | S | N | Al | Cu | Cr | Ni | Ti | V | Nb | Mo |
|---|---|---|---|---|---|---|---|---|---|---|---|---|---|---|
| St15 (28348) | 0.024 | 0.006 | 0.196 | 0.005 | 0.008 | 0.0047 | 0.039 | 0.009 | 0.014 | 0.032 | 0.001 | 0.001 | 0 | 0.002 |
| St14 (48188) | 0.027 | 0.009 | 0.201 | 0.007 | 0.009 | 0.0036 | 0.041 | 0.038 | 0.033 | 0.040 | 0.001 | 0.002 | 0.001 | 0.002 |
| ZStE220i (15343) | 0.023 | 0.019 | 0.188 | 0.005 | 0.005 | 0.0038 | 0.046 | 0.023 | 0.022 | 0.038 | 0.019 | 0.001 | 0 | 0.004 |
| ZStE220i (47669) | 0.024 | 0.011 | 0.193 | 0.011 | 0.005 | 0.0048 | 0.037 | 0.011 | 0.021 | 0.030 | 0.021 | 0.004 | 0 | 0.004 |
| ZStE340 (33042) | 0.075 | 0.018 | 0.970 | 0.011 | 0.002 | 0.0062 | 0.046 | 0.021 | 0.023 | 0.032 | 0.017 | 0.004 | 0.046 | 0.002 |

TABLE 2

| Steel grade | Yield strength MPa | Tensile strength MPa | Elongation to Fracture | $BH_2$ MPa |
|---|---|---|---|---|
| St15 (EN10 130) | up to 180 | 270 to 330 | at least 40 | — |
| St15 (5 min 500° C.) | 150 | 300 | 36 | at least 38 |
| St15 (2 min 700° C.) | 190 | 330 | 30 | at least 58 |
| ZStE220i (SZAG W5/94) | from 220 | 300 to 380 | at least 36 | — |
| ZStE220i (5 min 500° C.) | 220 | 340 | 34 | at least 41 |
| ZStE220i (2 min 700° C.) | 250 | 360 | 28 | at least 80 |
| ZStE340 (SEW093) | 340 to 440 | 410 to 530 | at least 20 | — |
| ZStE340 (5 min 500° C.) | 380 | 470 | 22 | at least 15 |
| ZStE340 (2 min 700° C.) | 380 | 480 | 20 | at least 35 |
| ZStE220 BH (SEW064) | 220 to 280 | 320 to 400 | at least 30 | from 40 |

What we claim is as follows:

1. Process for producing a cold-rolled strip or sheet of steel with good deforming properties and a bake-hardening potential after a subsequent deforming and for a subsequent temperature treatment, comprising the steps of:

hot rolling, coiling, cold rolling and recrystallizing annealing a strip of steel, wherein the recrystallizing annealing is carried out in a bell-shaped furnace, the coiled strip is cooled to ≦150° C. after the recrystallizing annealing, the strip is uncoiled and heated to a temperature T of 200° C.≦T≦$A_1$, briefly annealed at the temperature T for a period of ≦20 minutes and then cooled from said temperature T at a cooling rate of ≧1° C./s.

2. Process according to claim 1, wherein the temperature is T≧450° C.

3. Process according to claim 1, wherein the annealing period of the brief annealing is between 2 minutes and 5 minutes.

4. Process according to claim 1, wherein the cooling from the temperature T is performed at a cooling rate of ≧20° C./s.

5. Process according to claim 1, wherein the strip or sheet is dressed before the brief annealing.

6. Process according to claim 1, wherein, the strip or sheet is dressed after the brief annealing.

7. Process according to claim 1, wherein hot galvanizing of the sheet or strip is used as part of the brief annealing.

8. Process according to claim 1, wherein said strip of steel has a carbon content of ≧0.02%.

9. Process according to claim 1, wherein said strip of steel has a steel grade selected from the group consisting of St12 to St15, ZStE and ZstEi.

10. Cold-rolled strip or sheet having good deforming properties and a bake-hardening potential after a deformation and for a subsequent temperature treatment, comprising 0.02 to 0.12 wt. % C max. 0.5 wt. % Si 0.1 to 1.2 wt. % Mn max. 0.1 wt. % P max. 0.025 wt. % S max. 0.009 wt. % N 0.01 to 0.08 wt. % Al 0.01 to 0.04 wt. % Ti and being manufactured so as to have a good planar isotropy by hot rolling, coiling, cold rolling, recrystallizing annealing in a bell-shaped furnace, and so as to have a bake-hardening potential by cooling the coiled strip to ≦150° C. after the recrystallizing annealing, uncoiling the trip and reheating the uncoiled strip to a temperature T of 200° C.≦T≦$A_1$, briefly annealing at the temperature T of ≦20 minutes and then cooling from said temperature T at a cooling rate of 24 1° C./s.

11. Cold-rolled strip or sheet according to claim 10, produced from a steel of the steel grade St12, St13, St14 or St15.

12. Cold-rolled strip or sheet according to claim 10, produced from a steel of the steel grade ZstEi.

13. Cold-rolled strip or sheet according to claim 10, produced from a steel of the steel grade ZStE.

14. Cold-rolled strip or sheet according to claim 10, further comprising a hot-galvanized surface.

15. Cold-rolled strip or sheet according to claim 14, being dressed after the hot galvanizing of the surface.

16. Stove-enamelled sheet, produced from a strip or sheet according to claim 10, with a yield strength significantly increased by the stove-enamelling.

* * * * *